US005953557A

United States Patent [19]

Kawahara

[11] Patent Number: 5,953,557

[45] Date of Patent: Sep. 14, 1999

[54] IMAGE FORMING APPARATUS WITH CONTROLLED TONER CHARGING VOLTAGE

[75] Inventor: Ichiro Kawahara, Kashiwazaki, Japan

[73] Assignee: NEC Corporation, Japan

[21] Appl. No.: 09/199,683

[22] Filed: Nov. 25, 1998

[30] Foreign Application Priority Data

Nov. 28, 1997 [JP] Japan ..... 9-328540

[51] Int. Cl.[6] ..... G03G 15/08

[52] U.S. Cl. ..... 399/88; 399/281; 399/284

[58] Field of Search ..... 399/53, 55, 88, 399/138, 281, 284, 285

[56] References Cited

U.S. PATENT DOCUMENTS

| | | | |
|---|---|---|---|
| 4,314,755 | 2/1982 | Kinashi | 399/44 |
| 5,473,417 | 12/1995 | Hirano | 399/285 |
| 5,519,471 | 5/1996 | Nishimura et al. | 399/284 |
| 5,628,043 | 5/1997 | Ikeda et al. | 399/281 |
| 5,761,590 | 6/1998 | Sato | 399/285 |

FOREIGN PATENT DOCUMENTS

| | | |
|---|---|---|
| 1-136179 | 5/1989 | Japan . |
| 4-34465 | 2/1992 | Japan . |
| 4-57079 | 2/1992 | Japan . |
| 6-186830 | 7/1994 | Japan . |
| 8-50420 | 2/1996 | Japan . |
| 8-50421 | 2/1996 | Japan . |

*Primary Examiner*—Joan Pendegrass
*Attorney, Agent, or Firm*—Ostrolenk, Faber, Gerb & Soffen, LLP

[57] ABSTRACT

An image forming apparatus can effectively restrict a phenomenon to lower a charge amount of toner on a developing roller according to increasing of number of printing to stabilize supply of toner for a latent image carrier body and whereby to maintain good printing condition for a long period. The image forming apparatus includes a latent image carrier body, a developing roller supplying a toner to a latent image formed on the latent image carrier body, a toner supply roller supply the toner contacting the developing roller, a thin film forming member restricting a toner amount and a toner charge amount on the developing roller contacting with the developing roller, and power source means for supplying a bias to the toner supply roller and the thin film forming member in such a manner that a relationship between a voltage Vsr and a current Isr satisfies $|Vsr|/a+|Isr|/b=1$ (where a and b are constants of power source characteristics).

4 Claims, 11 Drawing Sheets

RELATIONSHIP BETWEEN CURRENT VALUE AND TONER FOGGING

IMAGE FORMING APPARATUS WITH CONTROLLED TONER CHARGING VOLTAGE

BACKGROUND OF THE INVENTION

1. Field of the Invention

The present invention relates generally to an image forming apparatus, such as a printer, facsimile and so forth employing an electrophotographic process. More particularly, the invention relates to an image forming apparatus which can maintain supply of toner for a latent image carrier body in stable state for a long period.

2. Description of the Related Art

The conventional image forming apparatus has a photo conductor drum (latent image carrier body), a developer and a power source. The developer includes a developing roller supplying a toner to the photo conductor drum, a toner supply roller supplying the toner to the developing roller and a thin film forming member forming a thin film layer of the toner supplied to the developing roller for restricting a toner deposition amount and a charge amount for the developing roller. To the toner supply roller and the thin film forming member, a bias voltage and current from the power source is applied. On the other hand, to a rotary shaft of the developing roller, a constant voltage is applied.

Upon developing a latent image on the photo conductor drum with the toner, the toner to be supplied onto the developing roller by rotation of the toner supply roller and the developing roller with sliding contact therebetween, is formed into a uniform thin film by the thin film forming member. At this time, the toner is charged by frictionizing between the toner supply roller and the developing roller and by frictionizing the thin film forming member and the developing roller, and then is supplied to the photo conductive drum.

FIG. 8 is a graph showing a charge bias characteristics in the conventional image forming apparatus. A hatched area in the graph shown in FIG. 8 shows a region A where printing (photographic printing) is good in quality. A graph shown by a wavy line is the first prior art in a case where a constant voltage control is performed at −600V. In this prior art, by supplying a constant voltage at −600V to the toner supply roller and the thin film forming member, a fluctuation of a charge amount of the toner on the developing roller can be reduce, and in conjunction therewith, lowering of the charge amount of the toner on the developing roller associated with printing can be restricted. In general, as a value of the constant voltage, the same value as a constant voltage Vb applied to the developing roller or a greater value than the constant voltage Vb is used.

On the other hand, a graph shown by one-dotted line represents the second prior art and illustrates a characteristics of an image forming apparatus of the type, in which a constant current is applied to the toner supply roller and the thin film forming member, as disclosed in Japanese Unexamined Patent Publication No. Heisei 9-106172. In the second prior art, by supplying a constant current of 3 [$\mu$A] to the toner supply roller and the thin film forming member, the similar effect as that of the first prior art can be obtained.

In the first and second prior arts, an impedance characteristics of a developer in the vicinity of lift time as use limit is risen to be higher than that in the case of the brand new condition immediately after starting of use.

FIG. 9 is a graph showing a correlation between a potential difference and fogging of toner. In FIG. 9, smaller value of fogging of toner represents lesser fogged portion of toner (contamination) to achieve better image. Smaller potential difference |Vsr−Vb| between the voltage Vsr applied to the toner supply roller and the thin film forming member and an applied voltage Vb for the developing roller, it can be appreciated from the graph that a charge amount of toner is lowered to frequently cause white fogging depositing toner in the white blank portion, or so forth to degrade printing quality. FIG. 10 is a graph showing a relative relationship between the current value and the fogging of toner. From this graph, when a current Isr applied to the toner supply roller and the thin film forming member becomes smaller, the charge amount of toner is lowered to frequently cause white fogging depositing toner in the white blank portion, similarly to the case of the potential difference.

As set forth above, when the voltage Vsr or the current Isr is increased, an applied voltage Vb for the developing roller is influenced so that the applied voltage Vb, voltage Vsr or the current Isr can not be constant value to constantly cause disturbance of waveform. By this, it becomes difficult to charge the toner to uniformly deposit the toner on the developing roller.

FIG. 11 is a graph showing a correlation between a product of the voltage Vsr and the current Isr and an Isr amplitude value. In FIG. 11, a disturbance of waveform is expressed by an amplitude value Δ of the Isr current waveform and the product of the voltage Vsr and the current Isr is taken as an absolute value Wsr [mW]. From the graph, it can be appreciated that the amplitude value Δ tends to increase associating with increasing of the absolute value Wsr.

For example, when the developer has the developer impedance characteristics in the firs prior art of FIG. 8, in order to obtain good printing condition by applying a voltage of −400[V], it becomes necessary to apply a current Isr of greater than or equal to 3.0 [$\mu$A] to the toner supply roller and the thin film forming member.

Here, discussion will be given, as one example, for the case where an absolute value Wsr as a product of the voltage Vsr and the current Isr to be applied to the toner supply roller and the thin film forming member is less than or equal to 2.5 [mW]. For example, in the first prior art illustrated in FIG. 8, a bias to be applied to the toner supply roller and the thin film forming member is controlled at a constant voltage of −600[V]. Therefore, at the initial stage of use (brand-new state), the current Isr of about 4.0 [$\mu$A] becomes necessary, and at the end stage of use (close to end of life), the current Isr of about 2.3 [$\mu$A] becomes necessary. In this case, while the absolute value Wsr [mW] does not exceed 2.5 [mW] at both of the initial stage and the end stage, the current Isr becomes lower than 3.0 [$\mu$A] at the end stage. Namely, since the current Isr to be supplied to the toner supply roller and the thin film forming member becomes smaller according to increasing of number of times of printing, it is quite difficult to restrict lowering of the charge amount of the toner on the developing roller. As a result, dot sharpness can be degraded to degrade printing quality to lower resolution of half-tone meshing or to cause thickening of character. On the other hand, it is also cause degradation of toner fogging phenomenon depositing toner to the portion to be white blank portion where the toner should not be deposited.

On the other hand, in the case where the developer has the developer impedance characteristics in the second prior art illustrated in FIG. 8, in order to obtain a good printing state by supplying the current Isr of 3.0 [$\mu$A], it becomes necessary to apply the voltage Vsr of about −550[V] at the initial state and the voltage Vsr of about −650[V] at the end state, commonly to the toner supply roller and the thin film forming member. In this case, the voltage Vsr to be applied to the toner supply roller and the thin film forming member becomes greater according to increasing of number of times of printing to possibly cause defects similarly to that set forth above.

SUMMARY OF THE INVENTION

It is an object of the present invention to provide an image forming apparatus which can effectively restrict lowering of a charge amount of toner on a developing roller according to increasing of number of times of printing, stabilize supply of toner for a latent image carrier body and maintain good printing condition over a long period.

In order to accomplish the above-mentioned object, according to one aspect of the present invention, an image forming apparatus comprises:

a latent image carrier body;

a developing roller supplying a toner to a latent image formed on the latent image carrier body;

a toner supply roller supply the toner contacting the developing roller;

a thin film forming member restricting a toner amount and a toner charge amount on the developing roller contacting with the developing roller; and power source means for supplying a bias to the toner supply roller and the thin film forming member in such a manner that a relationship between a voltage Vsr and a current Isr satisfies $$|Vsr|/a+|Isr|/b=1$$

where a and b are constants of power source characteristics.

In the image forming apparatus according to the present invention, the voltage Vsr and the current Isr applied to the toner supply roller and the thin film forming member upon formation of the image are varied to fall with in a region to achieve good printing quality in an applied bias characteristics with maintaining a relationship $|Vsr|/a+|Isr|/b=1$ during a period from initial stage of use to end stage. By this, lowering of charge amount of the toner on the developing roller can be effectively restricted to stabilize supply of toner for the latent image carrier body.

Here, the power source means may supply a power, at which the constant a of the power source characteristics satisfies a condition $a>|Vb|$ and the constant b satisfies a condition $b>3$, when a constant voltage Vb is applied to the developing roller. In this case, by optimally setting the values of the constants a and b, effect of restricting lowering of the charge amount of the toner can be further enhanced.

Further preferably, the power source means may include adjusting means which can adjust at least one of constants a and b of the power source characteristics. In this case, since effect of lowering of charge amount of the toner can be appropriately adjusted, adjustment of half-tone density, black solid density or so forth can be achieved.

Preferably, the power source means may include a constant voltage power source and a variable resistor inserted between the toner supply roller and the thin film forming member, and the constant voltage power source, and the adjusting means comprises the variable resistor. In this case, the adjusting means can be constructed quite simple.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessarily obscure the present invention.

Figure 1:
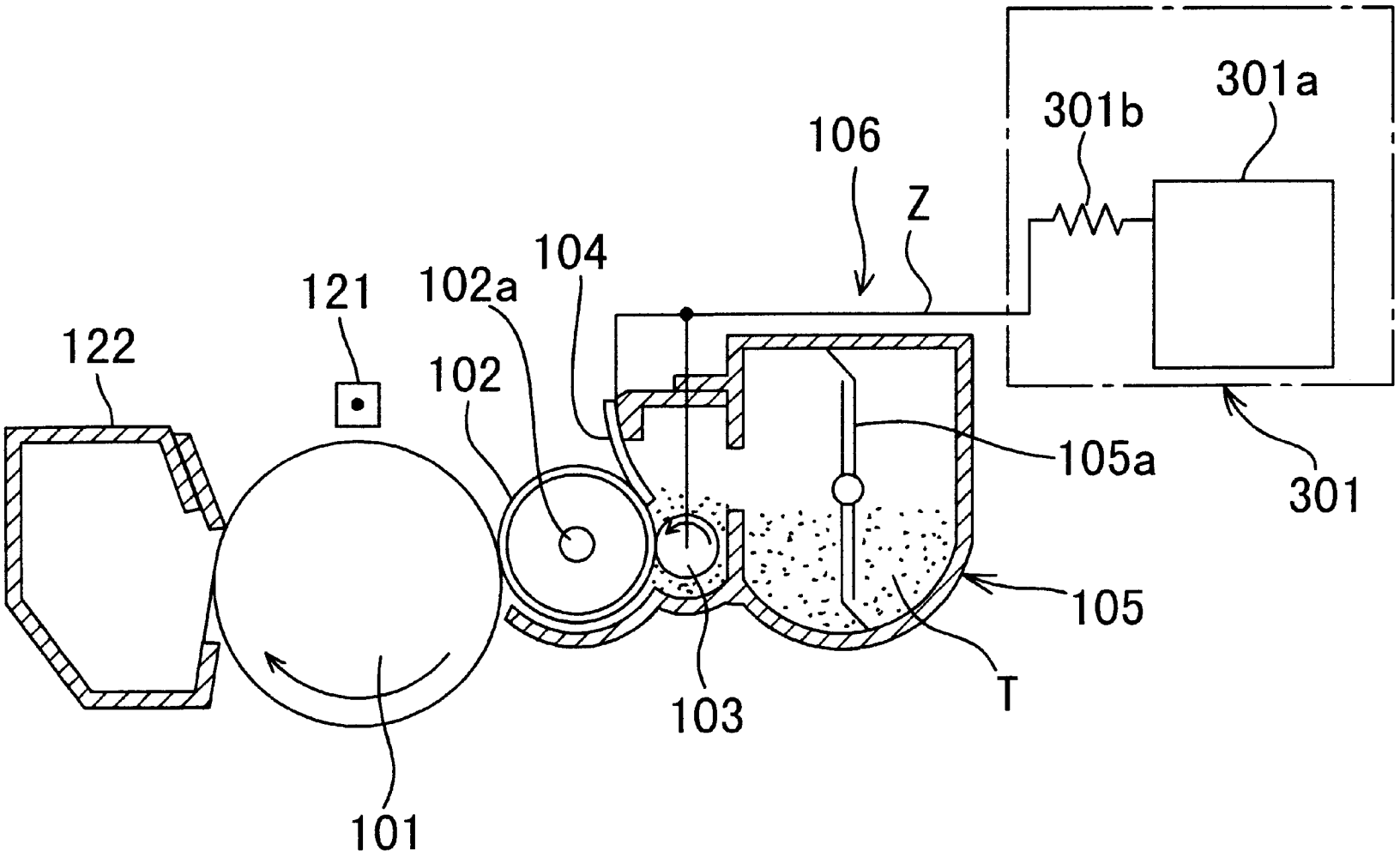
FIG. 1 is a sectional front elevation of the first embodiment of an image forming apparatus according to the present invention.

FIG. 1 is a section showing a condition as viewed from the front side of the first embodiment of the image forming apparatus according to the present invention. The first embodiment of the image forming apparatus includes a photosensitive drum (latent image carrier body) 101 rotating in one direction, a charger 121 for charging the surface of the photosensitive drum 101, a not shown exposure device, a toner recovery portion 122, a developer 106 and a power source portion 301.

The developer 106 includes a developing roller 102, a toner storing case 105 storing a toner T of a non-magnetic single component, a toner supply roller 103 supplying the toner T in the toner storing case 105 to the developing roller 102, and a thin film forming member 104. The developing roller 102 supplies the toner T to the latent image formed in the photosensitive drum 101 contacting with the photosensitive drum 101. The thin film forming member 104 forms a uniform thin film of the toner T supplied on the developing roller 102. In conjunction therewith, a toner deposition amount and charge amount is restricted on the developing roller 102.

The power source portion 301 has a constant voltage source 301*a* and a fixed resistor 301*b*, and is connected to the toner supply roller 103 and the thin film forming member 104 via an output terminal Z for applying a bias voltage and current to the toner supply roller 103 and the thin film forming member 104. Within the toner storing case 105, a stirring member 105*a* is arranged to supply the toner T to the toner supply roller 103 with stirring by rotation in one direction.

The developing roller 102 is formed with an elastic material having hardness in a range about 25 to 60 on JIS-A standard in consideration of a contact pressure between the thin film forming member 104 and the photosensitive drum 101. The elastic material is selected in consideration of leakage due to low resistance between the thin film forming member 104, the photosensitive drum 101 and the toner supply roller 103 or of degradation of efficiency of development to be caused due to high resistance. For realization of this, silicon, urethane or so forth which can set a resistance value in the extent of about $10^4$ to $10^8$[Ω] between the surface of the developing roller 102 and a rotary shaft 102*a*, is employed as the elastic material of the developing roller 102. To the rotary roller 102*a*, a constant bias in a range about −250 to −500[V] is applied.

The toner supply roller 103 is formed with a porous elastic material, such as silicon, urethane and so forth including a conductive sponge having an electrical resistance value in a extent about $10^3$ to $10^{10}$[Ω], an insulative sponge and so forth.

The thin film forming member 104 is formed with a metallic thin plate spring member of stainless, phosphor bronze or so forth, and a material prepared by adhering the elastic member, such as silicon, urethane and so forth, provided with conductivity, with a metallic thin plate. The developing roller 102 is depressed with uniform contact pressure. The contact pressure is desirably in a range of about 1 to 15 [gf/mm]. The thin film forming member 104 is not limited to one but can be a plural.

In the shown embodiment of the image forming apparatus, for the output terminal Z applying the bias to the toner supply roller 103 and the thin film forming member 104, a bias voltage Vsr and the current Isr is supplied to the power source portion 301 to employ the power source characteristics to satisfy the following expression.

$$|Vsr|/a+|Isr|/b=1 \quad (1)$$

where a and b are constants of the power source characteristics

Next, operation of the shown embodiment of the image forming apparatus will be discussed. On the surface of the photosensitive drum 101 which is charged by a charge from the charger 121, the latent image is formed by the exposure device. Then, the toner T is supplied to the photosensitive drum 10 by the developing roller 102. At this time, the toner T supplied to the developing roller 102 is formed to be uniform thin film by the thin film forming member. In conjunction therewith, frictionizing of the developing roller 102 and the toner supply roller 103, and frictionizing of the developing roller 102 and the thin film forming member 104, the toner T on the developing roller 102 is charged. The charged thin film form toner T on the developing roller contacts with the photosensitive drum 101 to develop the latent image on the photosensitive drum 101.

Figure 2:
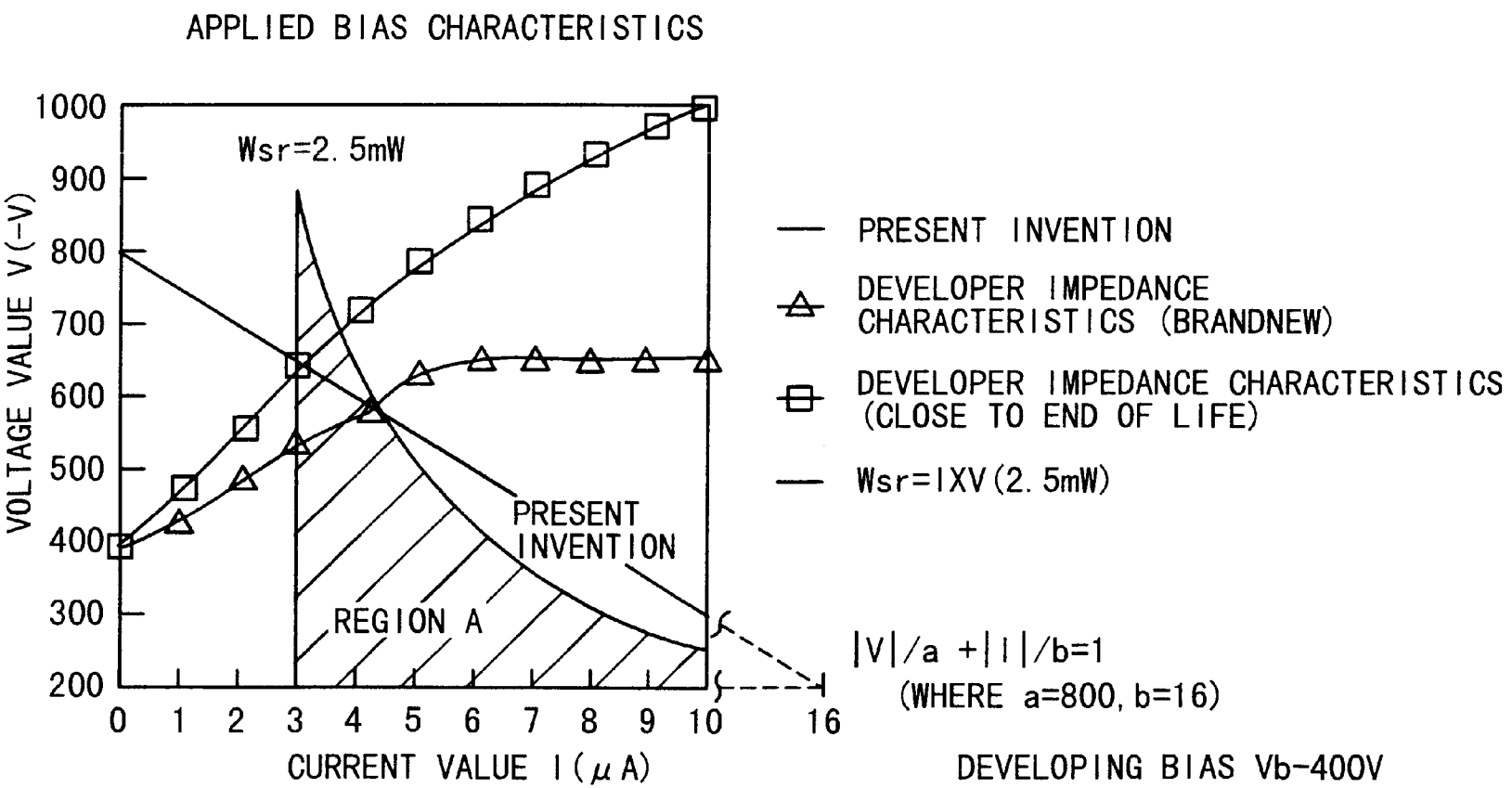
FIG. 2 is a graph showing a bias characteristics in the first embodiment of the image forming apparatus.

In order to restrict lowering and fluctuation of charge amount of the toner T on the developing roller 102 as set forth above, the bias is applied to the toner supply roller 103 and the thin film forming member 104. As discussed in respect of the prior art, by considering the characteristics shown in FIGS. 9 to 11, a region A where printing equality is high as shown in FIG. 2, can be obtained. Other than this region A, charging of the toner T on the developing roller 102 cannot be performed well to cause degradation of the half-tone meshing, fluctuation of density, fogging of toner on the white blank portion, thickening of the character or so forth.

Figure 8:
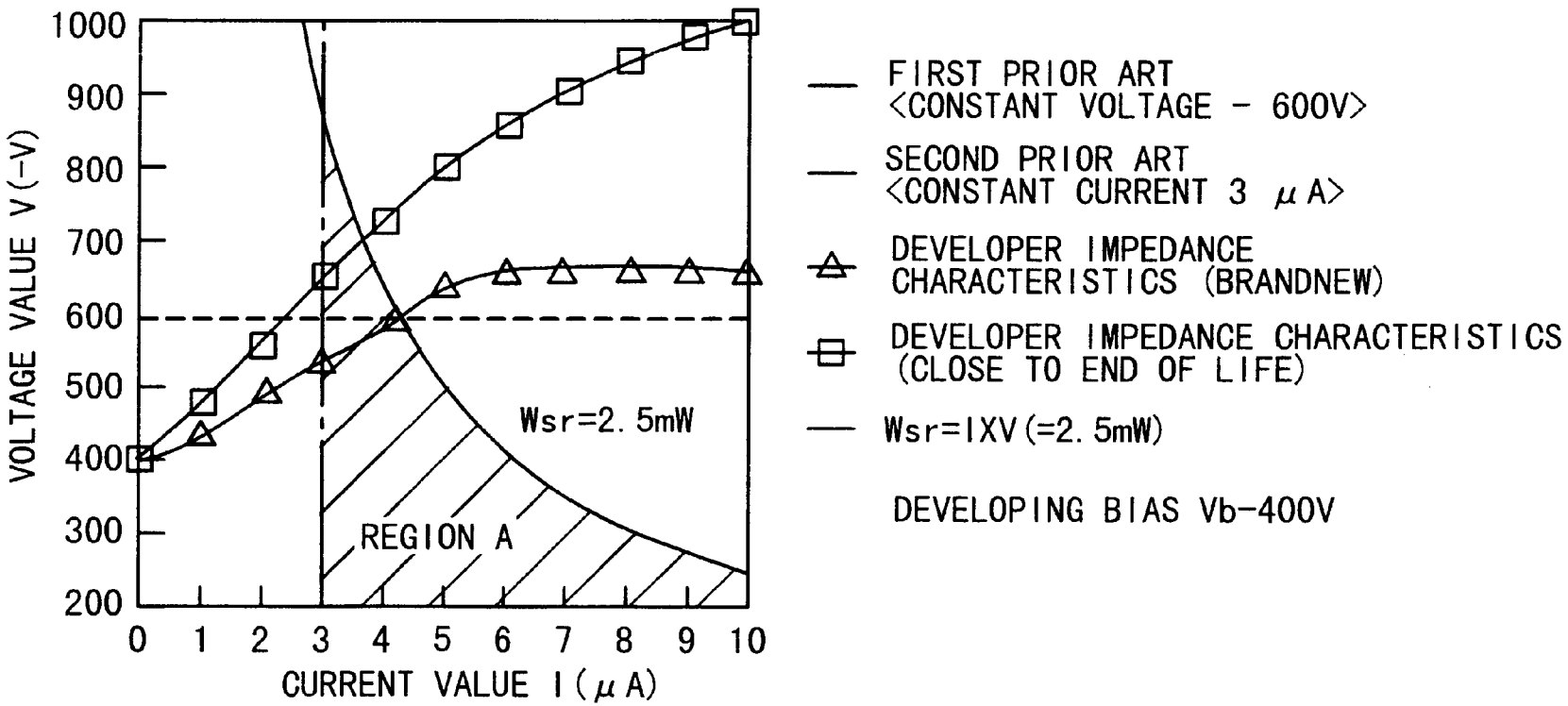
FIG. 8 PRIOR ART
FIG. 8 is a graph showing the conventional applied bias characteristics.

FIG. 2 is a graph showing an applied bias characteristics of the voltage and current for the toner supply roller 103 and the thin film forming material. In FIG. 2, the hatched region A represents a range equivalent to the region A of FIG. 8 and is set an absolute value Wsr of the product of the voltage Vsr and the current Isr to be less than or equal to 2.5 [mW].

The bias voltage Vsr[V] and the current Isr [μA] are varied from the initial state (brand-new condition) to the end state (close to end of the life) of use of the developer 106. In the shown embodiment, constants a and b of the power source characteristics is set so that the bias voltage Vsr and current Isr at the initial stage and the end stage of use may intersect with the developer impedance characteristic curve. By this, it becomes possible to maintain an optimal relationship between the bias characteristics applied to the toner supply roller 103 and the thin film forming member 104 satisfying the condition expressed by the foregoing equation (1) and the foregoing developer impedance characteristics. In the embodiment illustrated in FIG. 2, the constants a and b of the power source characteristics are set respectively a=800 and b=16. Also, the constant bias Vb applied to the developing roller 102 is set at −400[V].

By maintaining an optimal relationship between the bias characteristics satisfying the foregoing equation (1) and the developer impedance characteristics, the charge condition of the toner on the developing roller 102 can be maintained uniform. Thus, it becomes possible to restrict lowering of the charge amount of the toner on the developing roller 102 associating with printing. Also, it becomes possible to solve problems of degradation of dot sharpness, fluctuation of density or fogging of toner of the white blank portion, thickening of the character and so forth. Therefore, high printing quality can be maintained from initial stage of use to the end stage of use.

In order to obtain the bias characteristics satisfying the foregoing equation (1), a constant voltage power source 301*a* outputting a constant voltage a[V] and a fixed resistor 301*b* having a resistance value R of a/b [MΩ] are arranged in the power source portion 301. In this case, by employing a construction permitting variation of the voltage value a[V] of the constant voltage power source 301*a* and the resistance value a/b [MΩ] of the fixed resistor 301*b*, the constants a and b in the power source characteristics of |Vsr|/a+|Isr|/b=1 can be set at desired values.

Figure 3:
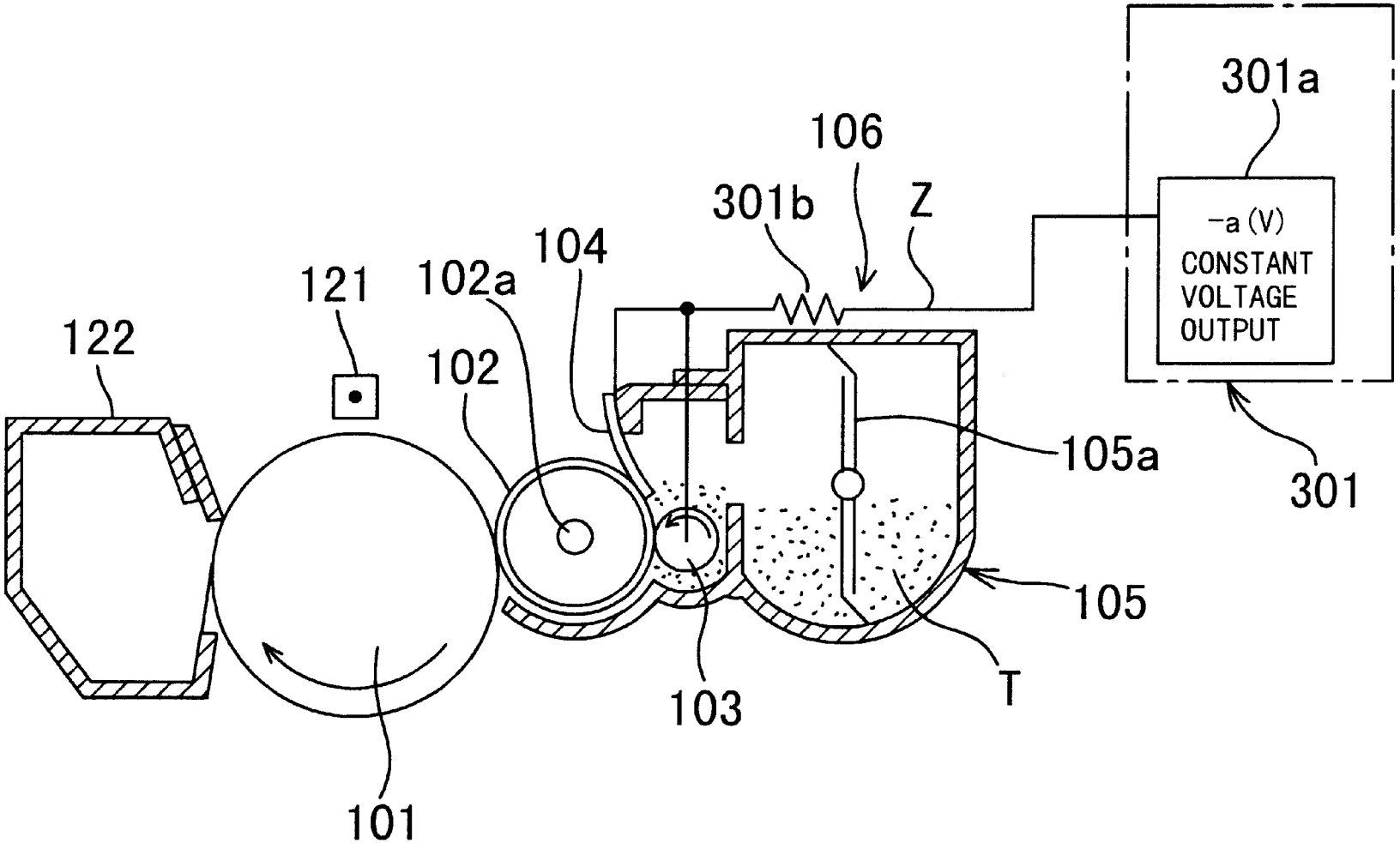
FIG. 3 is a sectional front elevation of the second embodiment of an image forming apparatus according to the present invention.

FIG. 3 is a sectional front elevation of the second embodiment of the image forming apparatus according to the present invention. In the shown embodiment, a construction of the power source portion 301 is differentiated from that of the first embodiment. Other construction is the same as the first embodiment. Namely, the fixed resistor 301*b* which is arranged within the power source portion 301 in the first embodiment, is arranged in the developer 106 located outside of the power source portion 301. Even with the shown embodiment constructed as set forth above, similar effect to the first embodiment can be achieved.

First Embodiment

Hereinafter, the preferred embodiments of the image forming apparatus according to the present invention will be discussed with reference to FIGS. 1, 2 and 9 to 11. The shown embodiment of the image forming apparatus is set a process speed at 90 [mm/sec]. The developing roller 102 is formed of urethane rubber having an electrical resistance value of $10^5$ to $10^7$[Ω], a surface roughness Rz of 5 to 19 [μm], and a rubber hardness of 45° to 55° in JIS-A. As the constant voltage bias Vb, −400[V] is applied. The toner supply roller 103 is formed with a conductive foamed urethane material. The thin film forming member 104 is formed with a stainless spring member having a thickness of 0.1 [mm] providing bending process at the tip end and contacting with the developing roller 102 at a contact pressure of 5 to 15 [gf/mm]. The toner T is consisted of a polyester resin type material having volume fixed resistance value in a extent of $10^{10}$ to $10^{15}$ [Ω·cm].

Figure 9:
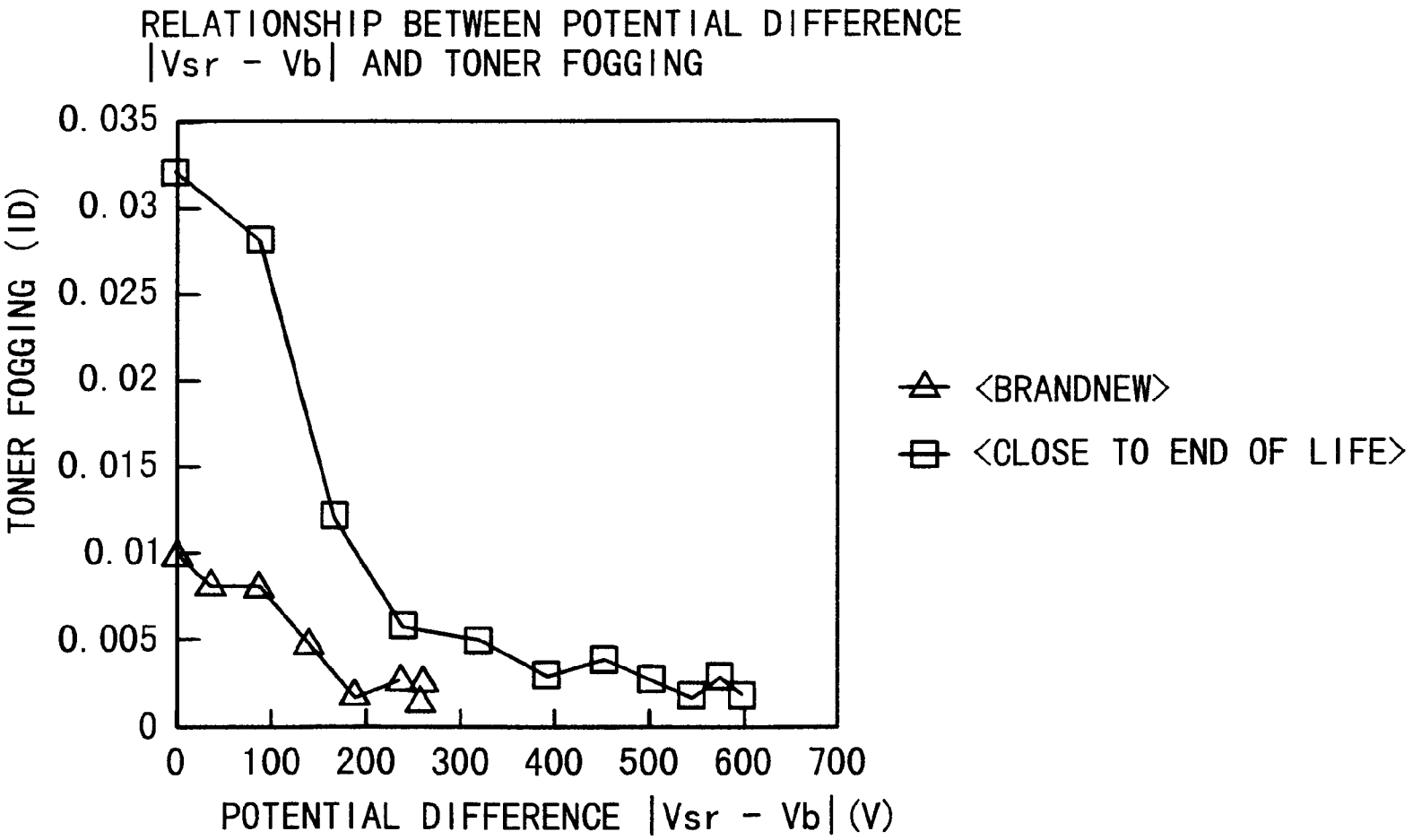
FIG. 9 PRIOR ART
FIG. 9 is a graph showing a correlation between a potential difference and a toner fogging.

From the graph of FIG. 9, in order to restrict blank fogging ID density of the white blank portion to be less than or equal to 0.01, it can be appreciated that the potential difference |Vsr−Vb| has to be set higher than or equal to 0[V] in the initial stage of use and about 200[V] in the end stage. Accordingly, in the initial stage of use, |Vsr| is set to be higher than or equal to about 400[V] and, in the end stage of use, |Vsr| is set to be higher than or equal to about 600[V]. On the other hand, from the graph of FIG. 10, in order to restrict blank fogging ID density of the white blank portion to be less than or equal to 0.01, it can be appreciated that, in the initial stage of use, |Isr| is set to be greater than or equal to 0 [μA], and, in the end stage of use, |Isr| is set to be greater than or equal to about 3.0 [μA]. Furthermore, from the graph of FIG. 11, according to increasing of the absolute value Wsr of the product of the voltage Vsr and the current Isr, the amplitude value Δ of the current waveform of the current Isr tends to be increased. In order to restrict the amplitude value Δ to be less than or equal to 0.1 [μA], it is appreciated that the absolute value Wsr has to be set to be less than or equal to about 2.5 [mW].

A region A in FIG. 2, satisfies all of the foregoing condition set forth with reference to FIGS. 9 to 11. When the power source portion 301 of FIG. 1 has the power source characteristics (bias characteristics) satisfies $$|Vsr|/800+|Isr/16=1$$

the foregoing problem can be solved to maintain high printing quality for a long period from initial stage of use to end stage of use. At this time, for the developer 106 in the initial stage of use, the bias voltage Vsr of −600[V] and the current Isr of 4 [μA] are supplied to the output terminal Z. For the developer 106 in the end stage of use, the bias voltage Vsr of −650[V] and the current Isr of 3.0 [μA] are supplied to the output terminal Z.

In the first embodiment, the bias characteristics |Vsr|/800+|Isr|/16=1 can be attained by setting the constant voltage value of the constant voltage power source 301*a* shown in FIGS. 1 and 3 at −800[V] and using the fixed resistor 301 having resistance value R of 50 [MΩ].

Second Embodiment

In the embodiment of the image forming apparatus, the process speed is set at 52 [mm/sec]. The developing roller 102 is formed of urethane rubber having an electrical resistance value of $10^5$ to $10^7$[Ω], a surface roughness Rz of 5 to 10 [μm ], and a rubber hardness of 45° to 55° in JIS-A. As the constant voltage bias Vb, −380[V] is applied. The toner supply roller 103 is formed with a conductive foamed urethane material. The thin film forming member 104 is formed with a stainless spring member having a thickness of 0.1 [mm] providing bending process at the tip end and contacting with the developing roller 102 at a contact pressure of 5 to 15 [gf/mm]. The toner T is consisted of a polyester resin type material having volume fixed resistance value in a extent of $10^{10}$ to $10^{15}$ [Ω·cm].

Under the setting set forth above, the characteristics is set in the similar manner as the first embodiment. At this time, the power source characteristics of the power source portion 301 is set $$|Vsr|/560+|Isr|/15.5=1$$

The power source characteristics can be obtained by setting the constant voltage a of the constant voltage power source 301 in FIGS. 1 and 3 at −560[V] and using the fixed resistor 301*b* having resistance value R of 36 [MΩ].

As can be appreciated from the first and second embodiments, in the power source characteristics of the present invention |Vsr|/a+|Isr|/b=1 (where a and b are constants of power source characteristics), the constant a is set at a value satisfying a>|Vb|. Furthermore, by setting the constant b at a value satisfying b>3 (namely 3 [μA]), fluctuation of the charge amount of the toner on the developing roller 102 can be reduced t lower charge amount of the toner on the developing roller 102 associating with increasing of the number of printing to maintain high printing quality for a long period from the initial stage of use to end stage of use.

The region A of FIG. 2 is variable depending upon the processing speed, the conditions relating to the developing roller 102, the constant voltage bias Vb, the toner supply roller 103, the thin film forming member, the toner T and so forth, or number of sheets to be printed, temperature, humidity. However, by varying the constants a and b of the bias characteristics, the optimal condition can be set.

Figure 4:
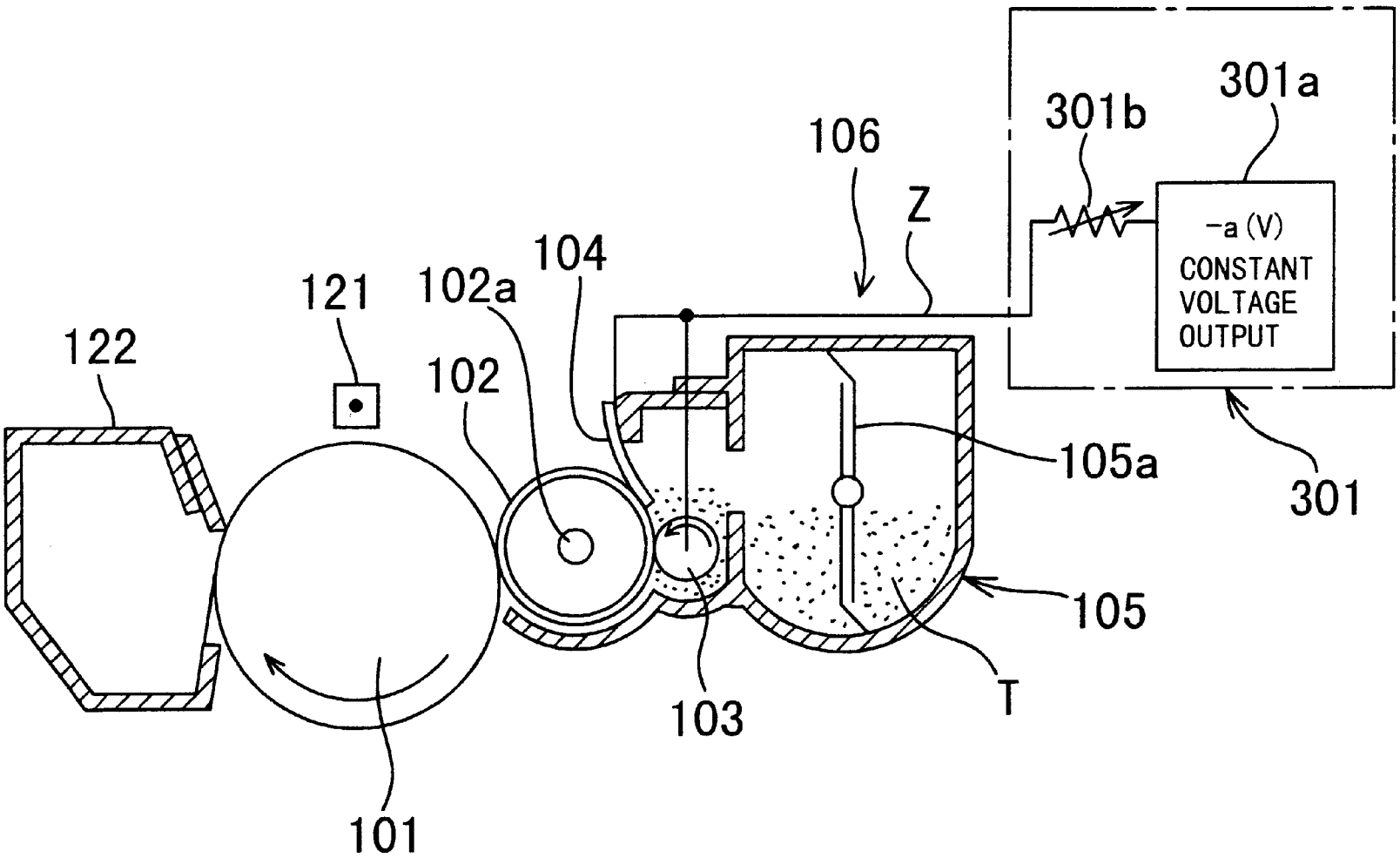
FIG. 4 is a sectional front elevation of the third embodiment of an image forming apparatus according to the present invention.

FIG. 4 is a sectional front elevation of the third embodiment of the image forming apparatus according to the present invention. Even in the shown embodiment, the construction of the power source portion 310 is different from that of the first embodiment but other construction is the same as the first embodiment. Namely, in the shown embodiment, the fixed resistor 301*b* in the first embodiment is arranged in the power source portion 301 as a variable resistor 301*c*. Even with the shown embodiment of the image forming apparatus, the similar effect to the first embodiment can be achieved.

In the shown embodiment of the image forming apparatus, by adjusting the resistance value R of the variable resistor 301*c*, the constant b in |Vsr|/a+|Isr|/b=1 (wherein a and b are constants of the power source characteristics) can be freely varied. In this case, b becomes a value derived by dividing the output voltage value a[V] of the constant voltage power source 301*a* with the set value of the variable resistor value R (b=a/R).

Figure 5:
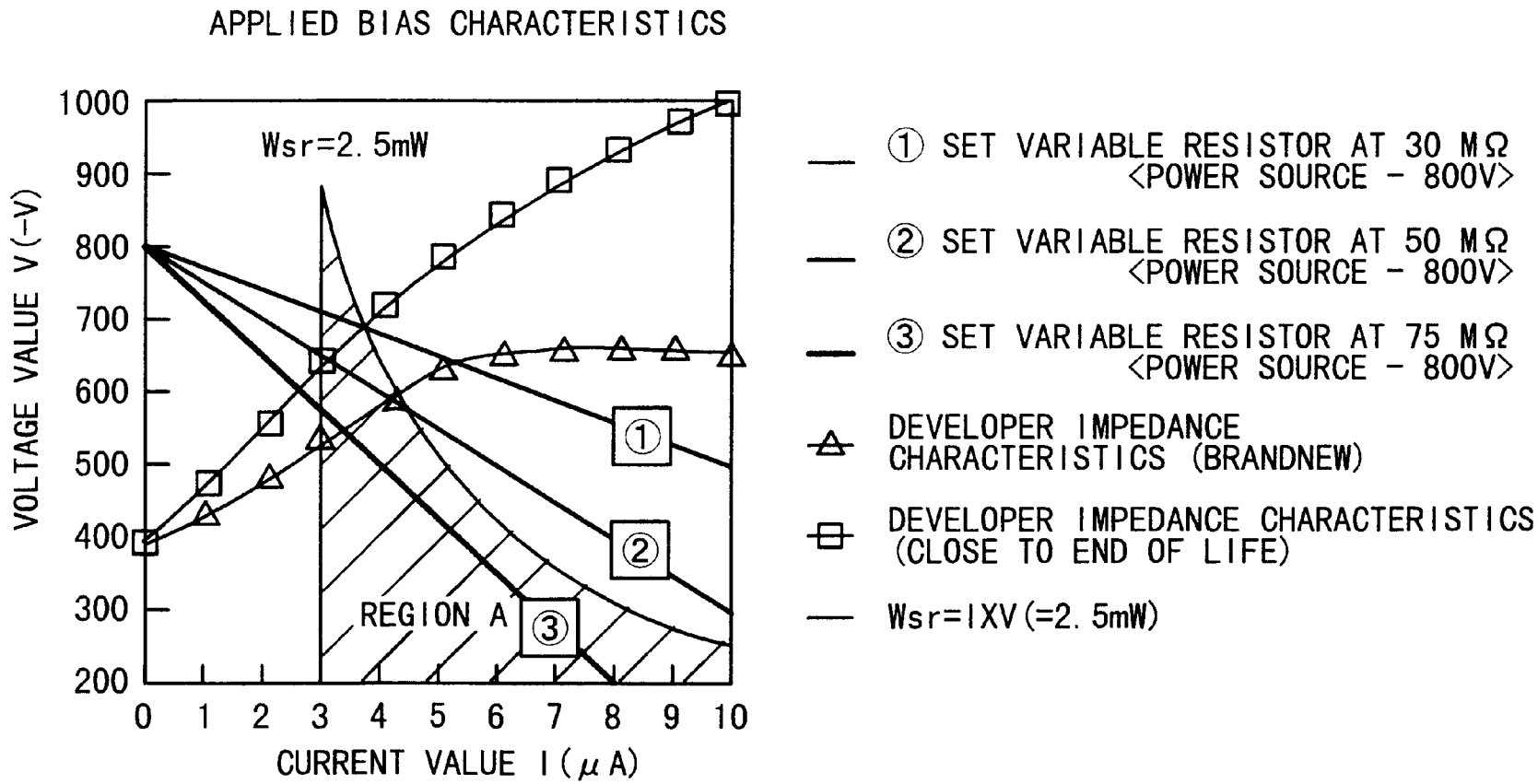
FIG. 5 is a graph showing a bias characteristics in the third embodiment of the image forming apparatus.

For example, discussion will be given with reference to the case of the first embodiment In the third embodiment, the output voltage value of the constant voltage power source 301*a* is set at −800V and the variable region of the variable resistor 301*c* is set in a range of 30 to 75 [MΩ]. Here, the voltage Vsr and the current Isr applied to the toner supply roller 103 and the thin film forming member 104 have the characteristics of ① to ③ shown in FIG. 5. FIG. 5 is a graph showing the applied bias characteristics in the third embodiment. In the shown graph, ① is the case where the resistance value of the variable resistor 301*c* is set at 30 [MΩ], ② is the case where the resistance value of the variable resistor 301*c* is set at 50 [MΩ] and ③ is the case where the resistance value of the variable resistor 301*c* is set at 75 [MΩ]. Namely, they are expressed by:

$$|Vsr|/800+|Isr|/26.7=1 \quad ①$$

$$|Vsr|/800+|Isr|/16=1 \quad ②$$

$$|Vsr|/800+|Isr|/10.7=1 \quad ③$$

From the above, it can be appreciated that, when the developer 106 is in the initial stage of use, by setting the resistance value R of the variable resistor 301*c* in a range of 50 to 75 [MΩ], and when the developer is in the end stage of use, by setting the resistance value R of the variable resistor 301*c* in a range of 30 to 50 [MΩ] to solve the problem. Particularly, in the first embodiment, in case of the developer 106 in the end stage, the resistance value R was set at 50 [MΩ], the voltage Vsr was set at −650[V] and the current Isr was set at 3.0 [μA]. In contrast to this, in the shown embodiment, the resistance value R was set at 30 [MΩ], the voltage Vsr was set at −700[V] and the current Isr was set at 3.7 [μA] to make both of the voltage Vsr and the current Isr greater than the case where the resistance value R is 50 [MΩ].

Figure 10:
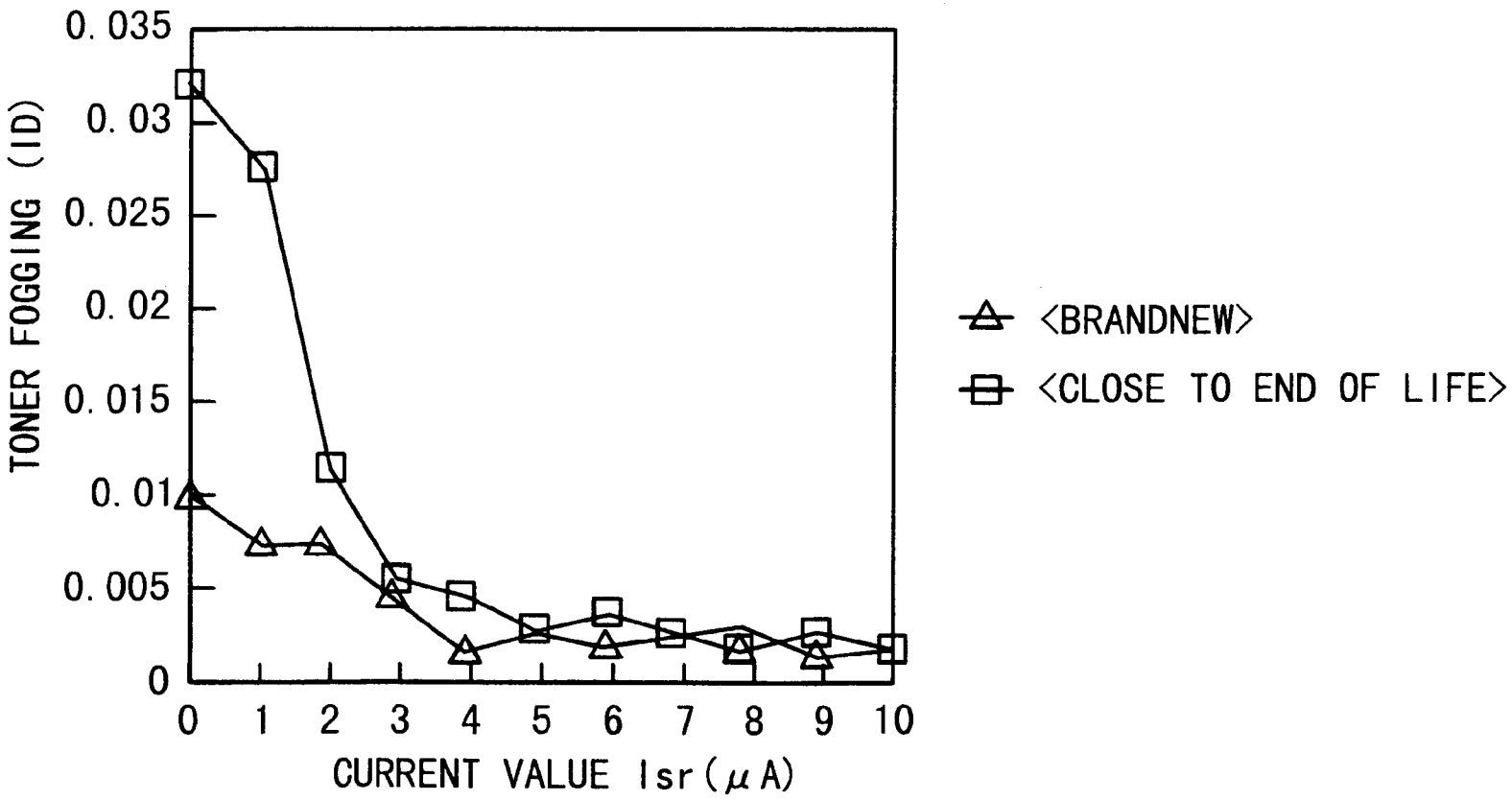
FIG. 10 PRIOR ART
FIG. 10 is a graph showing a correlation between a current value and a toner fogging.
Figure 11:
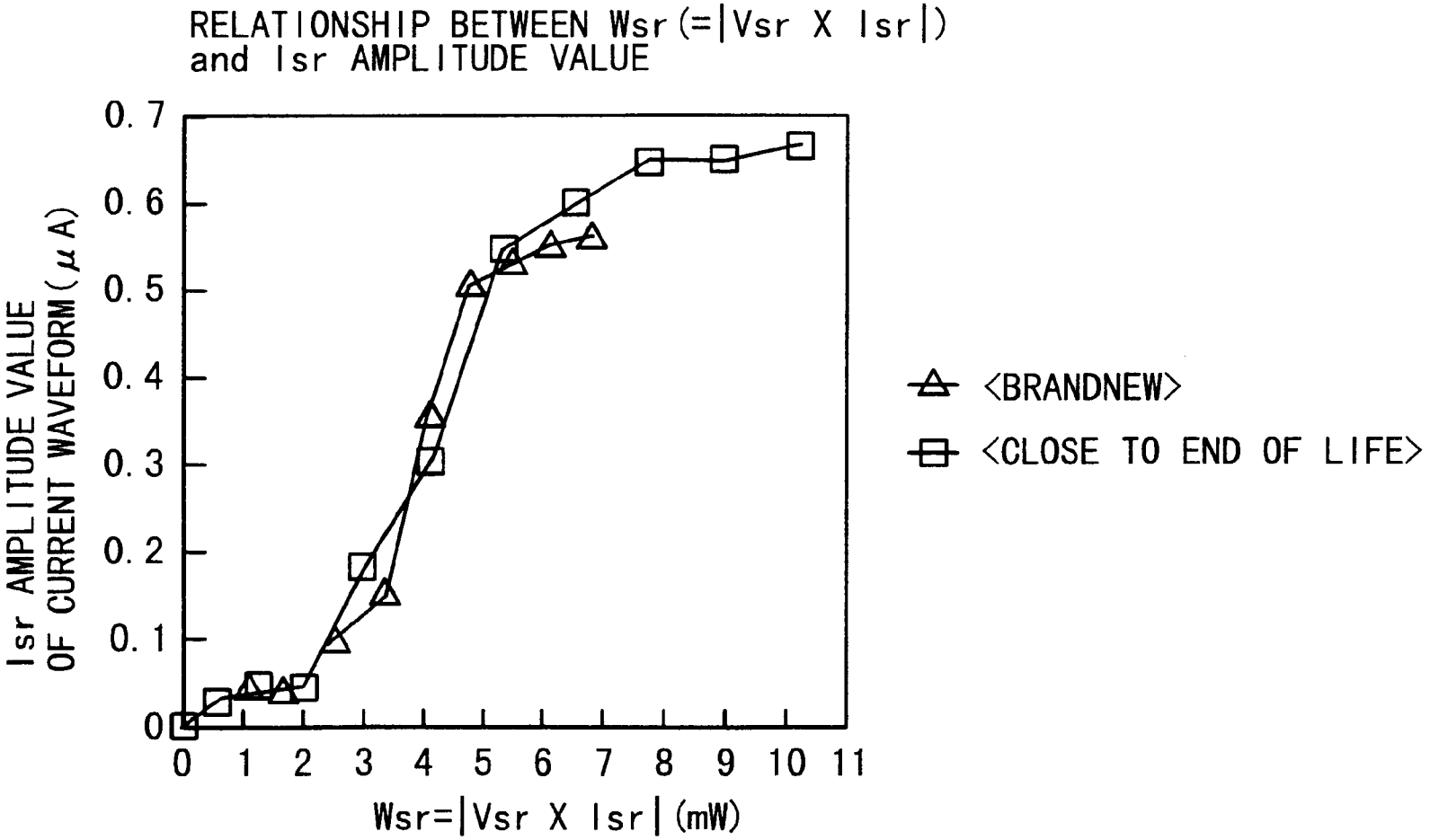
FIG. 11 PRIOR ART
FIG. 11 is a graph showing a correlation between an absolute value of a produce of the voltage value and the current value and the amplitude value of the current waveform.

Here, reference is made to FIGS. 9 and 10 discussed above. It can be appreciated that according to increasing of the voltage Vsr and the current Isr, margin for blank fogging of the white blank portion can be widened. Accordingly, margin for the blank fogging can be wider in the case where the resistance value R is set at 30 [MΩ] than the case where the resistance value R is set at 50 [MΩ] to achieve greater effect for solving the problem set forth above.

Figure 6:
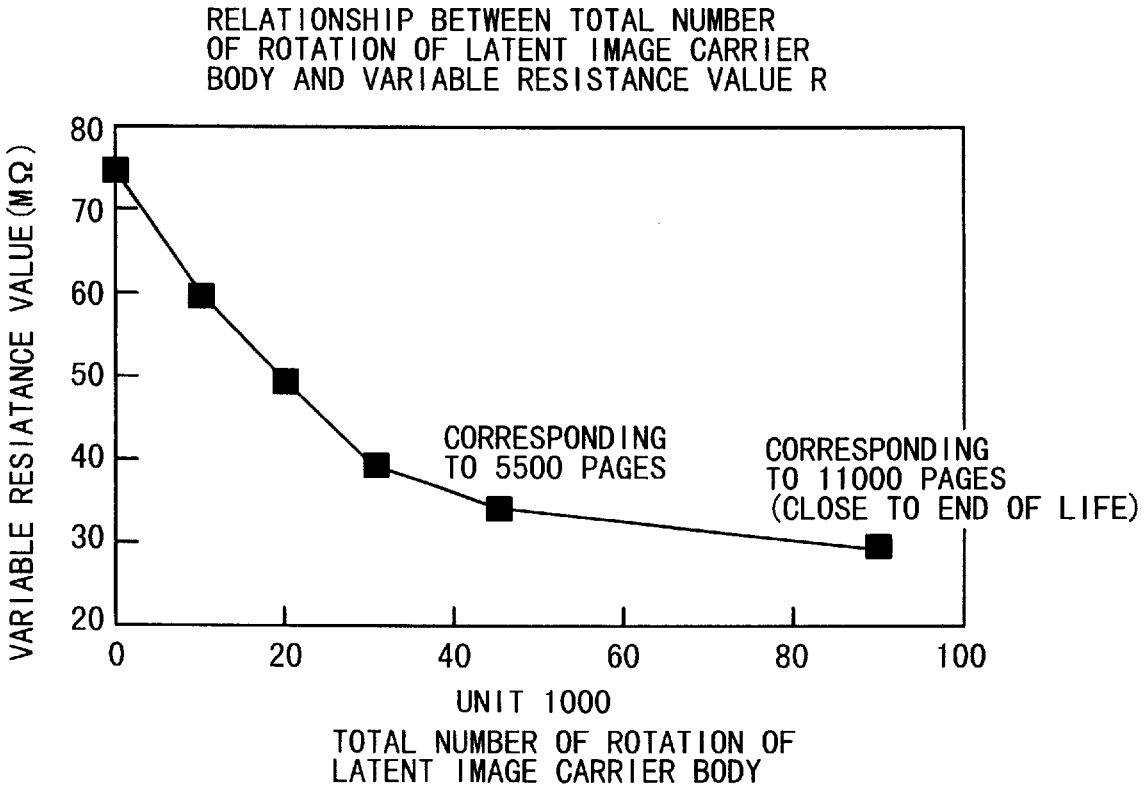
FIG. 6 is a graph showing a correlation between a total number of rotation of a photosensitive drum and a resistance value of a variable resistor.

FIG. 6 is a graph showing correlation between a total number of rotation of the photosensitive drum and the resistance value of the variable resistor in the case where the resistance value is adjusted automatically. As means for varying resistance value of the variable resistor 301*c*, there are manual method to perform adjustment manually by the user and the automatic method as illustrated in FIG. 6.

When the manual method is employed, since the resistance value R of the variable resistor 301*c* can be adjusted manually, it becomes possible to adjust density and tone adapting to preference of the user by varying a black solid density, half-tone density or half-tone resolution by adjustment of the resistance value R. On the other hand, when the automatic method is employed, with detecting number of rotation of the photosensitive drum 101 or the developing roller 102 by a control portion (not shown)m the resistance value R is adjusted automatically according to increasing of number of rotation. In the automatic method, for example, in case of the initial stage of use of the developer 108, the resistance value R is set at about 75 [MΩ], and in case of the end stage of use after performing printing corresponding to 11,000 pages, the resistance value R is automatically adjusted at about 30 [MΩ]. By this, further great effect can be achieved.

Figure 7:
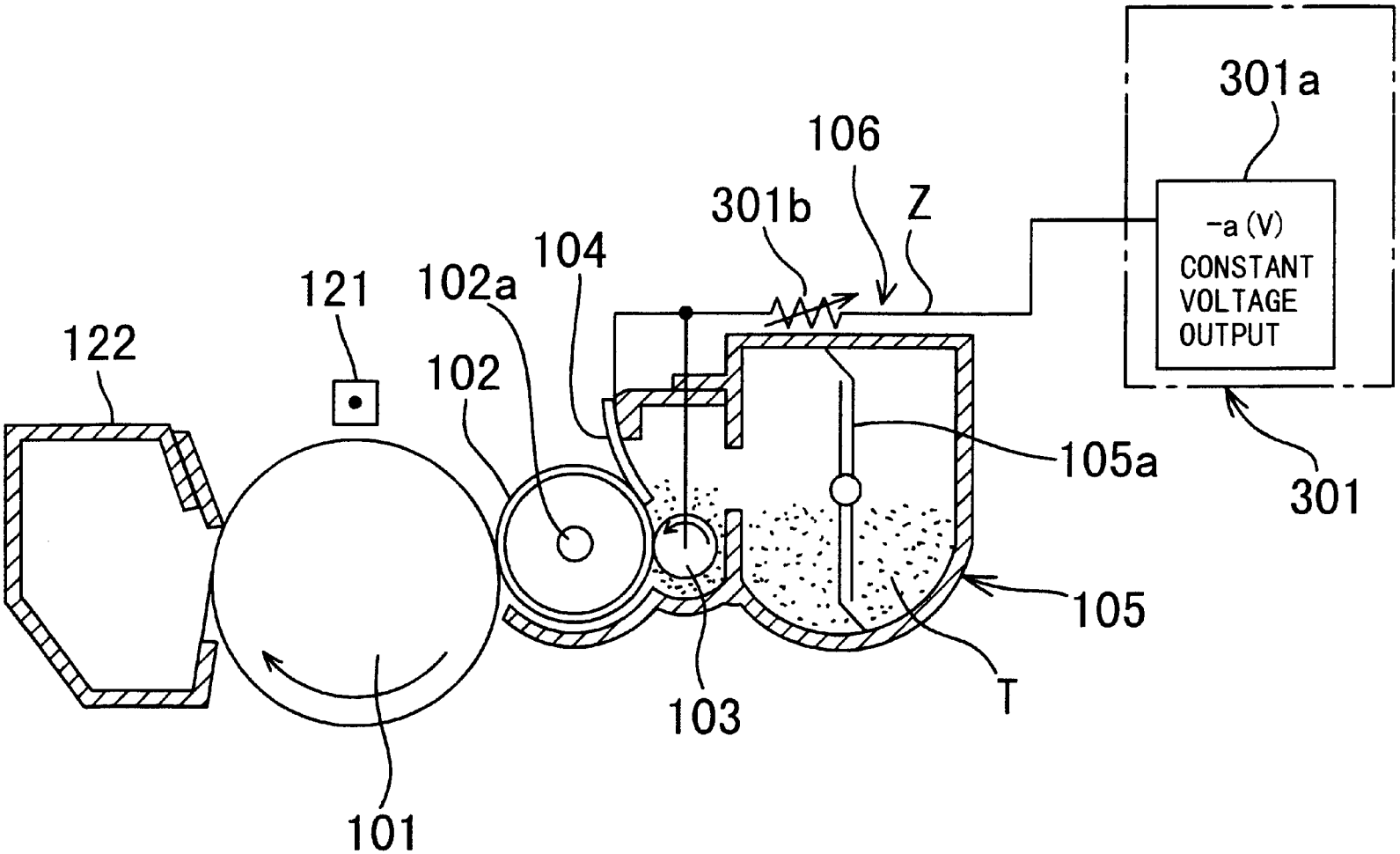
FIG. 7 is a sectional front elevation of the fourth embodiment of an image forming apparatus according to the present invention.

FIG. 7 is a sectional front elevation of the fourth embodiment of the image forming apparatus according to the present invention. Even in the shown embodiment, the construction of the power source portion 301 is different from that of the first embodiment, and other construction is the same as the first embodiment. Namely, the variable resistor 301*c* which is replacement of the fixed resistor 301*b* arranged in the power source portion in the first embodiment, is arranged in the developer 106 outside of the power source portion 301 in the shown embodiment. Even with this construction of the image forming apparatus, the foregoing problem can be solved to achieve the similar effect to that achieved by the first embodiment.

As set forth above, by the image forming apparatus according to the present invention, the phenomenon to lower charge amount of the toner on the developing roller according to increasing of number of printing can be effectively restricted to successfully stabilize supply of toner for the latent image carrier body to maintain good printing condition for a long period.

Although the image forming apparatus according to present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the image forming apparatus of the present invention should not be understood as limited to the specific embodiment set out above but to include all possible embodiments which can be embodied within a scope encompassed and equivalents thereof with respect to the feature set out in the appended claims.

What is claimed is:

1. An image forming apparatus comprising:

a latent image carrier body;

a developing roller supplying a toner to a latent image formed on said latent image carrier body;

a toner supply roller supply the toner contacting said developing roller;

a thin film forming member restricting a toner amount and a toner charge amount on said developing roller contacting with said developing roller; and power source means for supplying a bias to said toner supply roller and said thin film forming member in such a manner that a relationship between a voltage Vsr and a current Isr satisfies $$|Vsr|/a+|Isr|/b=1$$

where a and b are constants of power source characteristics.

2. An image forming apparatus as set forth in claim 1, wherein said power source means supplies a power, at which the constant a of the power source characteristics satisfies a condition a>|Vb| and the constant b satisfies a condition b>3, when a constant voltage Vb is applied to said developing roller.

3. An image forming apparatus as set forth in claim 1 or 2, wherein said power source means include adjusting means which can adjust at least one of constants a and b of said power source characteristics.

4. An image forming apparatus as set forth in claim 3, wherein said power source means includes a constant voltage power source and a variable resistor inserted between said toner supply roller and said thin film forming member, and said constant voltage power source, and said adjusting means comprises said variable resistor.

* * * * *